US007163087B2

(12) United States Patent
Putnam

(10) Patent No.: US 7,163,087 B2
(45) Date of Patent: Jan. 16, 2007

(54) PORTABLE VEHICLE LIFT

(76) Inventor: Brian Patrick Putnam, 7701 Wise, Apt. 1S, St. Louis, MO (US) 63117

( * ) Notice: Subject to any disclaimer, the term of this patent is extended or adjusted under 35 U.S.C. 154(b) by 203 days.

(21) Appl. No.: 11/012,773

(22) Filed: Dec. 15, 2004

(65) Prior Publication Data

US 2005/0133310 A1 Jun. 23, 2005

Related U.S. Application Data

(60) Provisional application No. 60/530,109, filed on Dec. 15, 2003.

(51) Int. Cl.
*B66F 7/00* (2006.01)

(52) U.S. Cl. ..... 187/203; 187/210; 187/211; 187/216; 187/269; 254/93 R; 254/122; 254/124; 254/126

(58) Field of Classification Search ..... 187/203, 187/210, 211, 214, 216, 269; 254/7 B, 10 B, 254/90, 93 A, 93 H, 122, 126, 124, 93 R
See application file for complete search history.

(56) References Cited

U.S. PATENT DOCUMENTS

| | | | | |
|---|---|---|---|---|
| 740,398 | A * | 10/1903 | Cheves | 182/131 |
| 848,332 | A * | 3/1907 | Westervelt | 254/8 R |
| 3,116,910 | A * | 1/1964 | Moore et al. | 254/126 |
| 4,901,980 | A * | 2/1990 | Hansen | 254/9 C |
| 6,069,263 | A * | 5/2000 | Yoneda et al. | 554/211 |
| 6,422,536 | B1 * | 7/2002 | Kelley et al. | 254/89 R |

* cited by examiner

*Primary Examiner*—Kathy Matecki
*Assistant Examiner*—Stefan Kruer
(74) *Attorney, Agent, or Firm*—Lathrop & Gage, L.C.

(57) ABSTRACT

The disclosed invention is a portable vehicle lift for elevating a motor vehicle. The lift includes spaced apart beams which are positioned under the vehicle, each beam has a plurality of hinged strut pairs, each with associated threaded collars. Strut pairs are moved together or apart by directionally rotating a threaded shaft through the threaded collars. Supplemental lift springs may be positioned along the shaft to selectively engage and urge the strut pairs during operation.

20 Claims, 6 Drawing Sheets

PORTABLE VEHICLE LIFT

CROSS REFERENCE TO RELATED PROVISIONAL PATENT

This non-provisional application claims priority of the provisional application No. 60/530,109 filed on Dec. 15, 2003.

FIELD OF THE INVENTION

The present invention generally relates to an improved portable vehicle lift for elevating a motor vehicle. More particularly, a lift is provided which has spaced apart beams for positioning under the frame or tires of the vehicle, each beam further having a plurality of hinged struts movable along threaded shafts and whereby directional rotation of the threaded shaft selectively elevates or lowers the struts and attached beam members.

BACKGROUND OF THE INVENTION

Numerous types of jacks and vehicle lifts have been patented to perform the same basic function of lifting a portion, or all, of a motor vehicle for service, repair, and even storage. Generally, jacks are manually operated devices used to lift one of four corners, or either the front half or back half of the vehicle off of the ground. Vehicle lifts are generally positioned under the vehicle tires or the vehicle frame, and through powered mechanisms such as hydraulic power, gears, pulleys and chains, and the like, elevate the entire vehicle off the ground.

The instant invention is a hybrid of a lift and a jack, in that it is a mechanically operated device that is used to lift the entire vehicle off of the ground. The inventive lift has few parts and is very easy to operate and is relatively inexpensive to manufacture. It is anticipated that the preferred use for the inventive device will be for "driveway mechanics" or individuals who work on their vehicles in their driveways or personal garages.

BRIEF DESCRIPTION OF THE DRAWINGS

The invention is illustrated using the following figures along with the detailed description of the invention.

DETAILED DESCRIPTION OF THE INVENTION

The present invention relates to an improved mechanical vehicle lift having spaced apart beam members for positioning under the chassis, frame or tires of a motor vehicle and by which the vehicle may be vertically elevated through mechanical actuation of a series of struts and threaded shafts.

Figure 1:
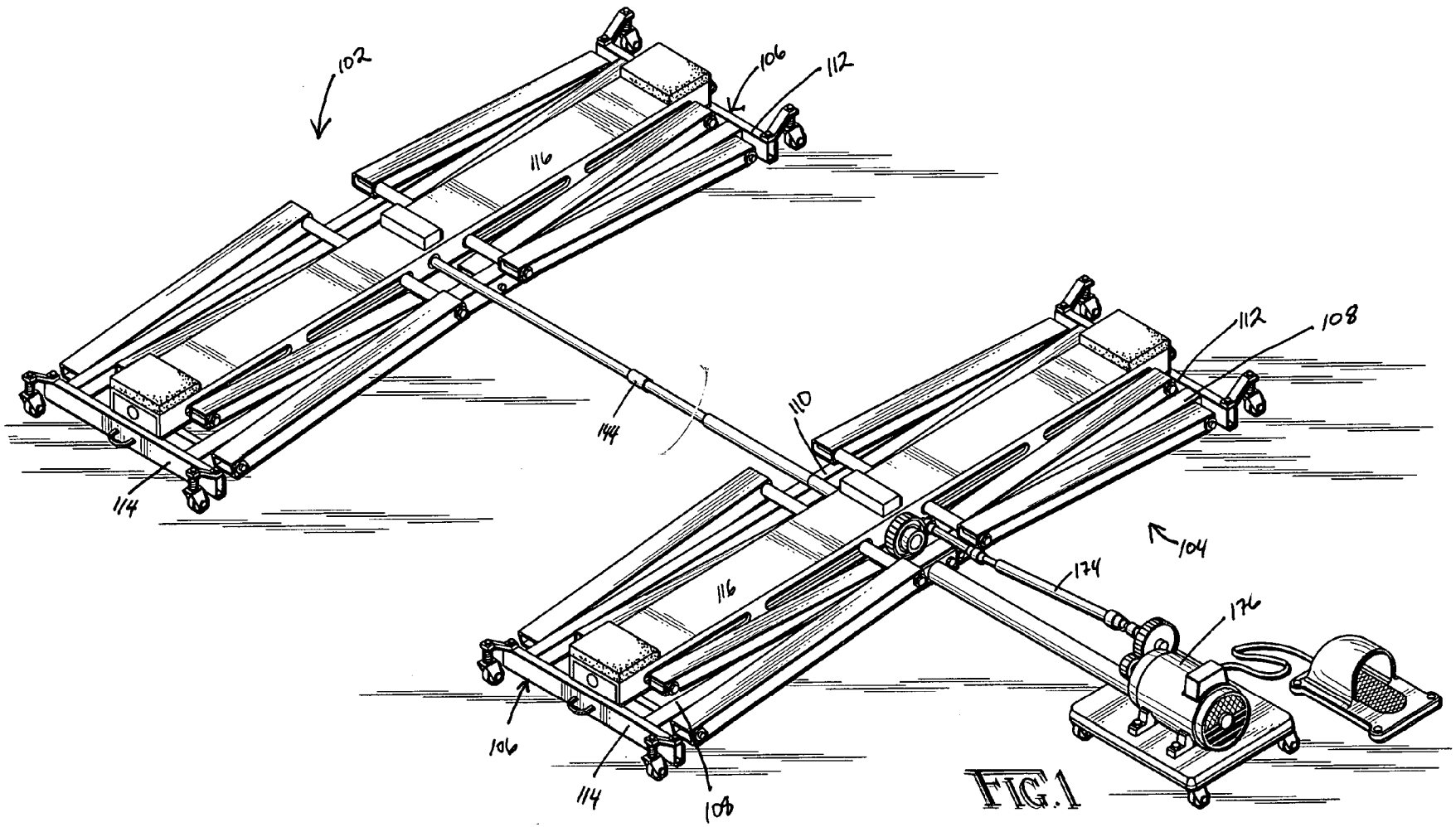
FIG. 1 is a perspective view of the inventive device.

Referring now generally to FIG. 1, the preferred embodiment of the vehicle lift 100 includes a left beam member 102 and a spaced apart right beam member 104. It is to be understood that the left beam member 102 and right beam member 104 are substantially identical and for the purpose of brevity, only one of the beam members will be described in detail.

Figure 2:
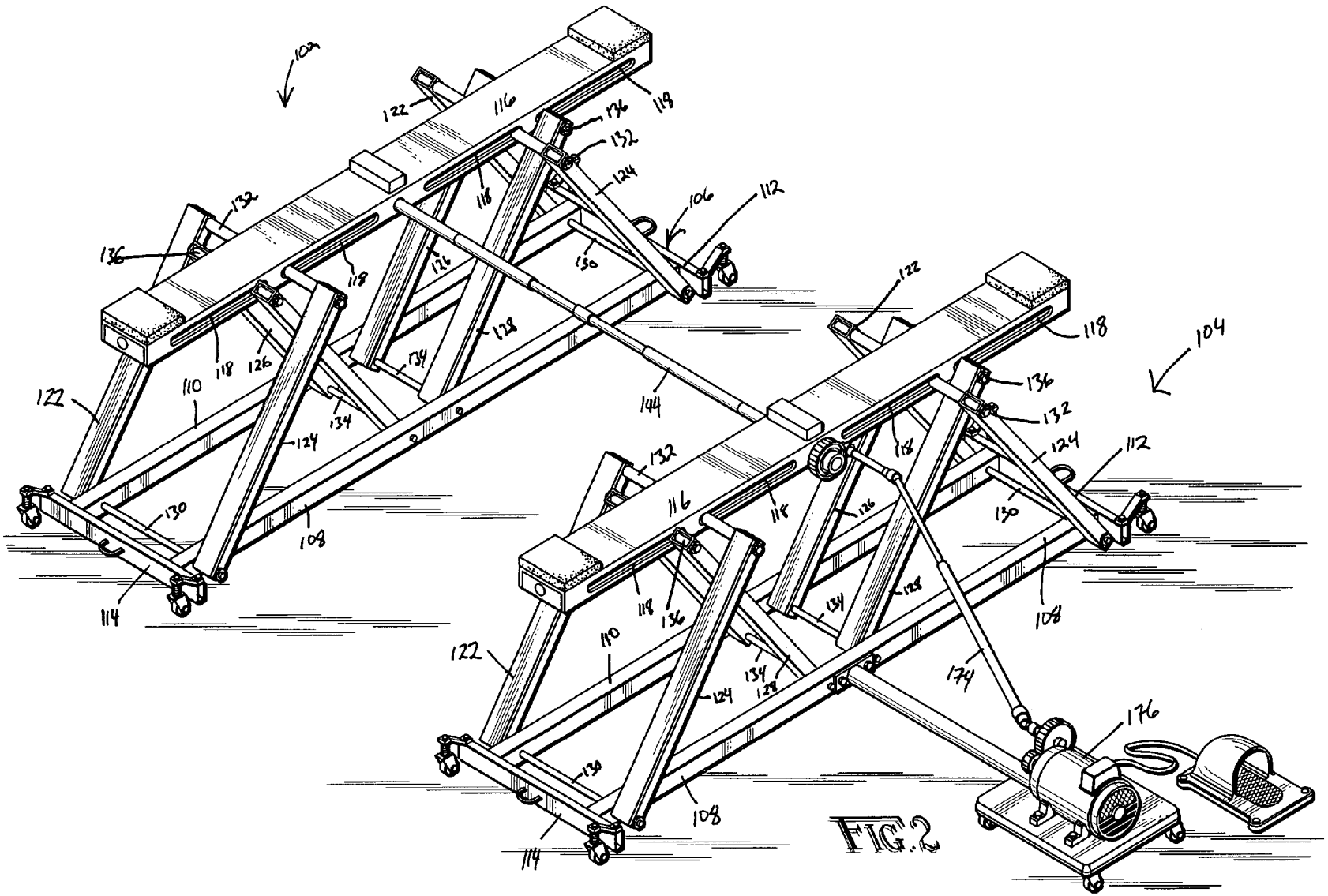
FIG. 2 is a perspective view of the device in an elevated orientation.
Figure 4:
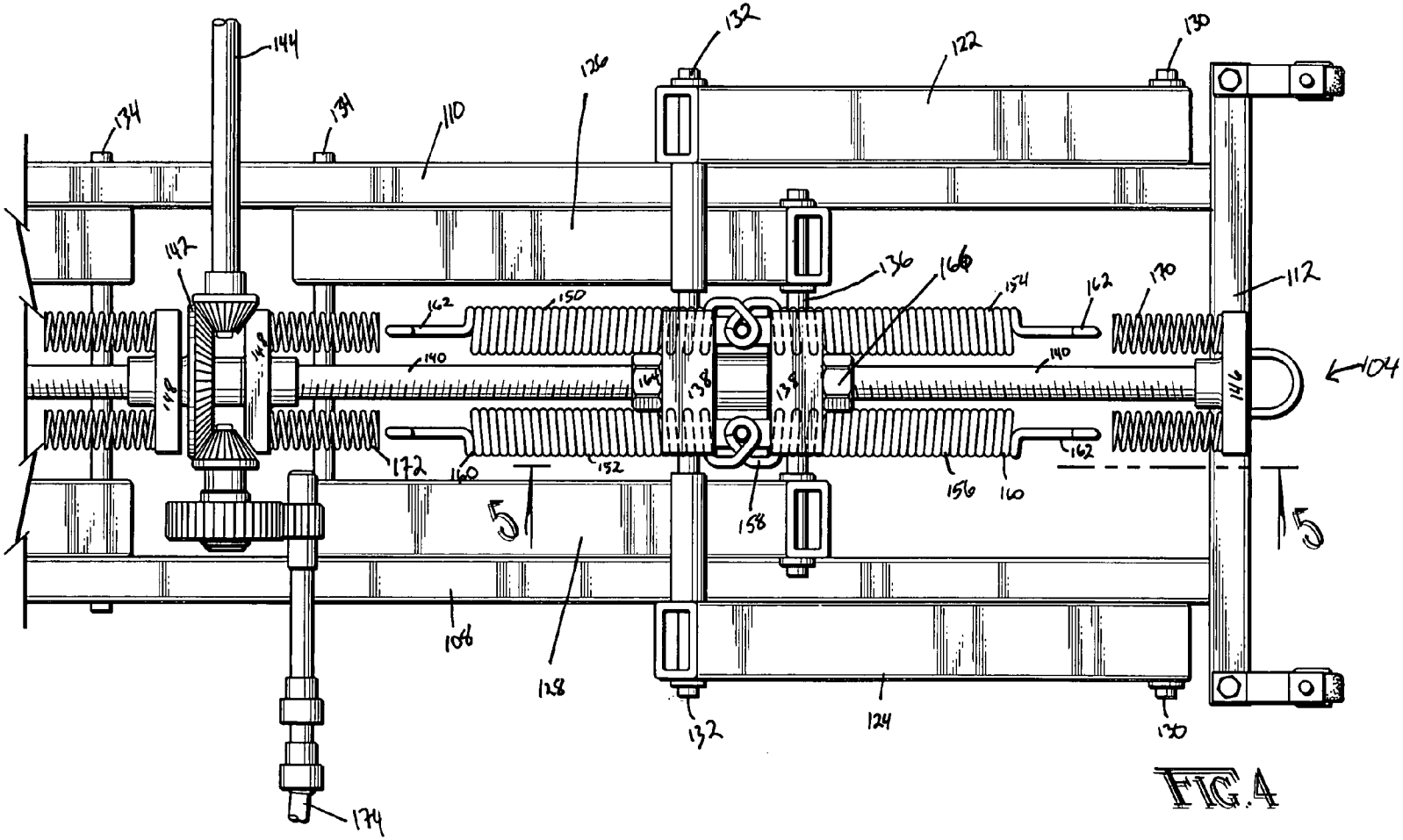
FIG. 4 is a partial plan view of the inventive device.

Each beam member 102, 104 further includes a substantially rectangular frame 106, preferably formed of channel or box steel. The frame 106 is formed from a spaced apart, parallel pair of side members 108, 110 and a spaced apart and parallel pair of end members 112, 114, one at either end of the longitudinal members and rigidly fixed thereto to complete the substantially rectangular frame 106. A beam plate 116 generally overlies the frame 106 extending beyond each end 112, 114 as best shown in FIG. 1. The beam plate 116 has multiple channels 118 formed down each side as shown in FIGS. 2 and 4.

Two pairs of struts are rotatably mounted to the longitudinal members of the frame. More particularly, a first pair of struts is positioned at one end of the frame 106 and a second pair of struts is positioned at the opposite end of the frame 106. Each pair of struts comprises a first and second outer strut arm 122, 124 positioned on the outside of the rectangular frame 106 and a third and fourth inner strut arms 126, 128 positioned inside of the rectangular frame 106. The second pair of struts are located at the opposite end of the frame member and in the same orientation as the first set of struts. As best shown in FIGS. 1 and 2, the beam 116 comprises the center portion of the assembly, the inner strut arms 126, 128 are positioned on either side of the beam, the frame 106 is then outboard the inner strut arms 126, 128 and finally, the outer strut arms 122, 124 are outboard the frame 106.

A long pin 130 is used to pivotally secure a first end of the outer strut arms 122, 124 substantially near the end of the frame 106. It should be understood that two short pins could be used to independently secure each strut arm to the frame. A second long pin 132 slidably maintains the second end of the outer strut arms 122, 124 within one of the channels 118 of the beam as best shown in FIG. 2. A third long pin 134 pivotally attaches the inner strut arms 126, 128 generally near the center of the frame. A fourth long pin 136 slidably maintains the second end of the inner strut arms 126, 128 to the center beam 116 through one of the slotted channels 118. This orientation is replicated at the opposite end of the lift, as shown in FIG. 2.

In the lower position, each lift is folded substantially flat because of the orientation of the inner 126, 128 and outer 122, 124 strut arms positioned on either side of the frame 106 with the center beam 116 fitted between the inner strut arms 126, 128. As shown in FIG. 2, the second pin 132 of the outer strut arms 122, 124 and the fourth pin 136 of the inner strut arms 126, 128 are positioned through the slotted channels 118 formed in the center beam 116. This allows the second or upper ends of the strut arms 122, 124, 126, 128 connected to the beam 106 to slide along the length of the beam 106 as the strut arms are elevated and lowered. The length of the slots 118 limit the height of the beam 106 as each pin engages the slot end.

Figure 3:
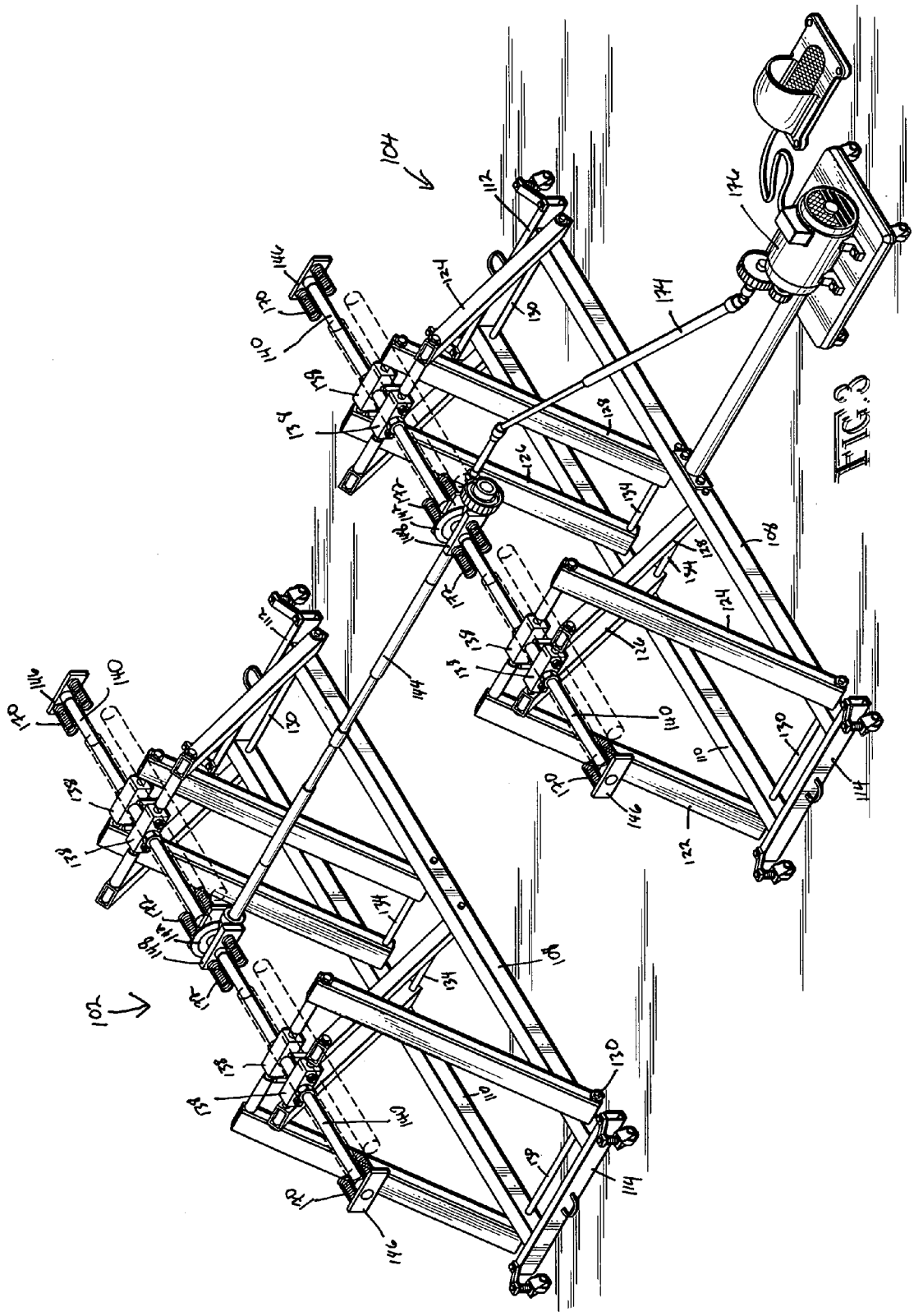
FIG. 3 is a partial perspective view of the device in an elevated orientation.

Referring to FIG. 3, the lift is shown without the beam 106 in place, displaying a full view of the lifting mechanism. Two threaded collars 138, preferably acme collars, are positioned on each strut pair, as shown with one on the second pin 132 of the outer strut arms 122, 124 and the fourth pin 136 on the inner strut arm 126, 128. A threaded shaft 140, preferably an acme threaded shaft, is passed through the threaded collars 138. As the threaded shaft 140 is rotated in a first direction, the threads of the shaft 140 forcibly move the collar 138 of the inner strut pin 136 towards the acme collar 138 position on the outer strut pin 132. This causes the respective struts to elevate as the collars move toward each other. As the shaft 140 is rotated in a second direction, the collars 138 are forced apart along the threads of the shaft declining the respective strut arms. This orientation is replicated on the other strut pair of the lift beam such that each lift beam includes a total of four threaded collars spaced along the threaded shaft 140.

Figure 6:
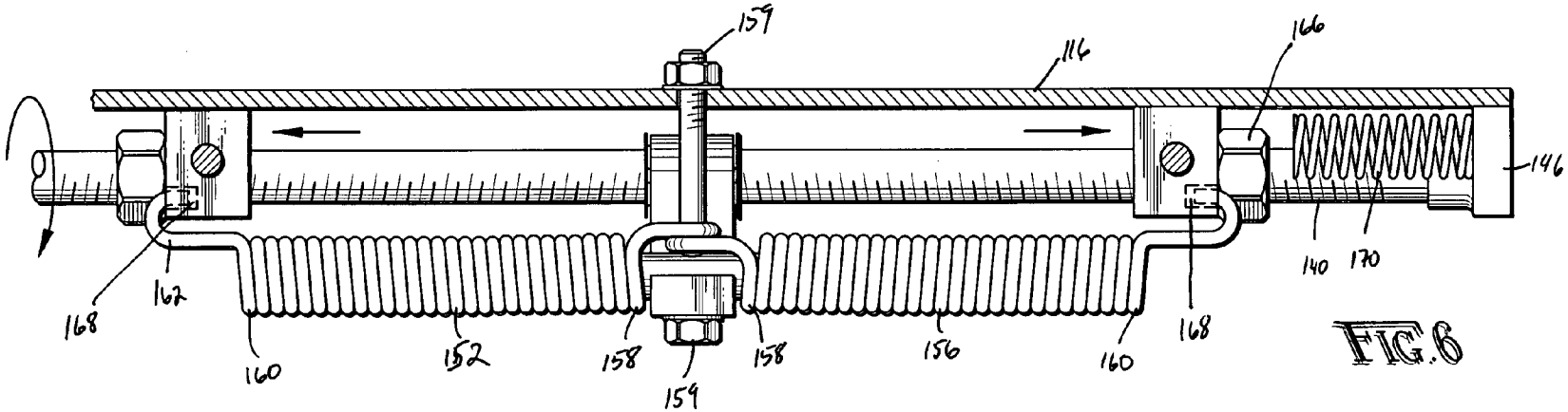
FIG. 6 is another partial end view of FIG. 5.

As best shown in FIGS. 3 and 4, the inner pair of strut arms 126, 128 is preferably connected to the outer pair of strut arms 122, 124 with a single long threaded shaft 140. This configuration allows both pairs of strut arms to be elevated simultaneously in precise increments. A miter gear 142 may be positioned on the threaded shaft intermediate the two pairs of strut assemblies. This allows the left and right beam assemblies to be elevated simultaneously with a long connecting crank 144 as best shown in FIGS. 3 and 6.

While the vehicle lift is operable as described above, it is preferable to include coiled springs between the strut arm pairs to supplement the lifting force of the struts and to decrease the required power to elevate the beams. As shown in FIGS. 3 and 4, an outer shaft seat 146 is fixed at each end of the threaded shaft 140. An inner shaft seat 148 is fixed adjacent to and on either side of the miter gear 142. Four coil springs 150, 152, 154, 156 for each strut pair are provided, with two springs 150, 152 positioned slightly below and on either side of the threaded shaft and oriented generally outboard and two springs 154, 156 positioned slightly below and on either side of the threaded shaft and oriented generally inward. Each of the springs 150, 152, 154, 156 have a first end 158 mounted to or near the threaded collar 138 on the fourth long pin on the outer strut arms 122, 124. The first end 158 is generally mounted to a bolt 159 depending from the beam 116. The second end 160 of each spring 150, 152, 154, 156 projects laterally away from the first spring end 158 substantially along the threaded shaft 140. At the second end of each spring 160 a hook 162 is formed and oriented generally upward toward the threaded shaft 140.

Two force nuts 164, 166 are positioned on the threaded shaft 140, for each strut arm pair. The first nut 164 is between the inner shaft seat 148 and the threaded collar 138 on the second long pin 132, and the second nut 166 is between the outer shaft seat 146 and the threaded collar 138 on the fourth long pin 136. This configuration is replicated on the opposite of the miter gear such that a total of four force nuts are on the threaded shaft of each beam member. The force nuts 164, 166 have opposing thread configurations such that as the threaded shaft is rotated they move in opposite directions. In the lowered position, the hooks 162 are in contact with the force nuts which extend the springs thereby imparting generally inward directional spring force from the spring onto the force nut. As the shaft 140 is rotated to elevate the beam, the force nuts move inward with the elevating threaded collars 138 and the inward spring force urges the nuts and associated threaded collar inward as the beam elevates. The force nuts disengage from the spring hooks as the lift continues to elevate.

As the threaded shaft 140 is rotated to lower the beam, the force nut 164 moves toward the inner shaft seat 148 and the second force nut 166 move toward the outer shaft seats 146. As the lift is lowered, the force nuts 164, 166 engage the hooks 162 on each spring 150, 152, 154, 156. It is preferable that each force nut be provided with a hook receptacle 168 which retains the end of each hook 162 as shown in FIGS. 5 and 6.

Figure 5:
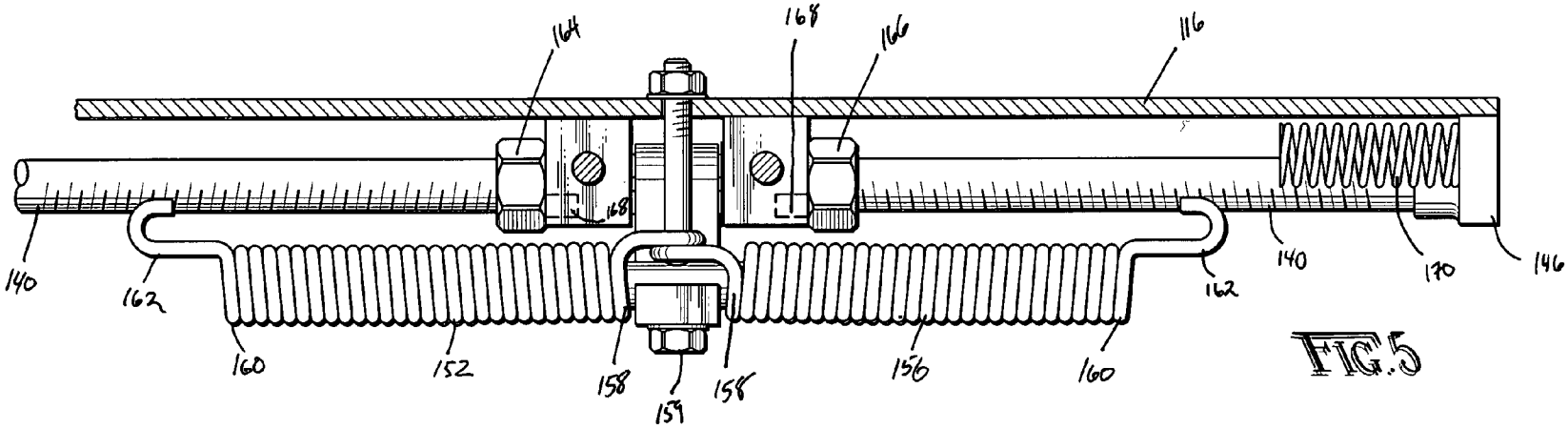
FIG. 5 is a partial end view taken along line 5—5 of FIG. 4.

As shown in FIGS. 5 and 6, as the threaded shaft 140 is rotated directionally to elevate the strut assemblies and associated beam members, the resilient springs which are connected at or near the second and fourth pins, engage the drive nuts as the drive nuts move outboard along the threaded shaft. The extension of the resilient springs impart stabilizing directional forces along the threaded shaft to reduce vibration during elevation of a vehicle and impart longitudinal forces along the threaded shaft to assist in the lifting of the beam member. The fourth drive nut is provided with a receptacle which engages a hook formed on the resilient springs.

It is preferable to include pairs of compression springs, outer compression springs 170 mounted on the outer shaft seat oriented inboard and inner compression springs 172 mounted on the inner shaft seat oriented outboard. These springs provide lift assistance as the beams first begin lifting and also cushion the downward forces as the beam is lowered to its lowermost point.

In yet another embodiment of the invention, a single pair of springs is utilized for each strut pair for a total of four springs per lift beam member. In this configuration, a resilient spring is mounted to the outboard rod seat and the inner shaft seat on either side of the threaded rod. In yet another embodiment of the invention, drive nuts are provided on the outer shaft seat and the inner shaft seat.

Figure 7:
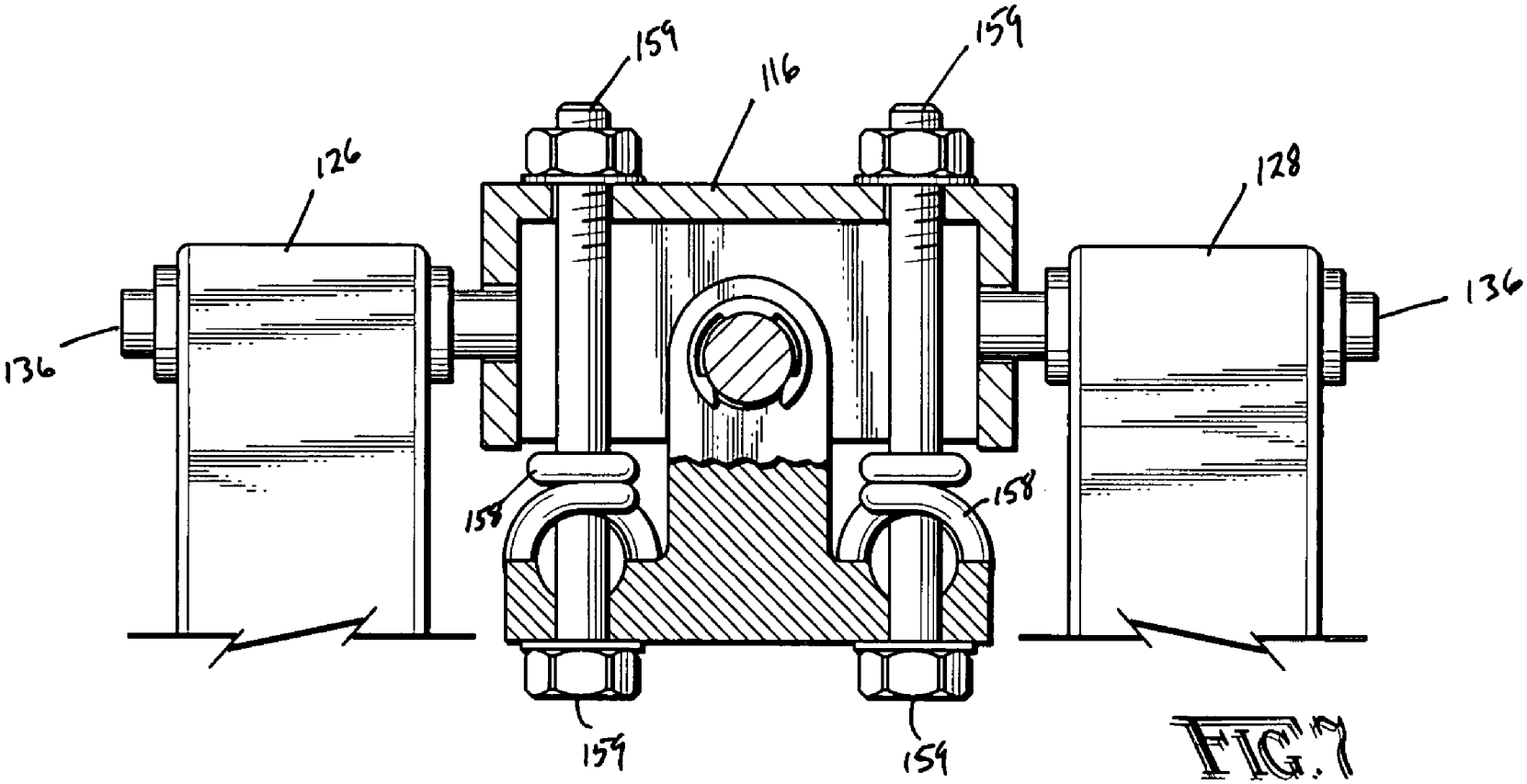
FIG. 7 is a partial view showing a spring assembly of the inventive device.

FIG. 7 shows the orientation of a pin through a strut pair with the attachment point for the first end of resilient springs 150, 152, 154, 156, generally a pin, bolt or similar fastener 159. This fastener may also be positioned completely through the beam plate 116.

In operation, the left and right side beam assemblies are connected with a connecting rod 144. The beam assemblies are then positioned substantially under the frame of the vehicle to be lifted. It is preferred the lift be positioned substantially between the front and rear tires of the vehicle and directly under the frame members. The crank is then attached to the center link and rotated in the first direction. The actuation of the crank causes the threaded shafts to turn in the miter gears and the threaded collars. The pins located in the threaded collars of each strut pair are forcibly moved together causing the strut arms to elevate. As the strut arms elevate, the pins slide in the provided channels on the center beam. The length of these channels limit the elevation height. To lower the vehicle, the crank is turned in the second rotational direction to reverse the threads in the threaded collars forcibly moving the strut arms away from each other, thereby lowering the center beam and the elevated vehicle.

This lift can be manually cranked, however, it is preferable to use an electric motor 176 attached via a crank rod 174 to turn the crank assembly. Use of the spring and force nut configuration decreases the size of the motor required to elevate a vehicle.

Casters or wheels may be mounted at each corner of the frame so that the device can easily be rolled under a vehicle. It may be possible to attach casters of enough strength so that, upon elevation of the vehicle, the entire vehicle can be rolled on the beam assemblies.

It will be apparent to those skilled in the art that various modifications and variations can be made in this vehicle lift of the present invention without departing from the spirit or scope of the invention. The present invention covers the modifications and variations of this invention provided they come within the scope of the appended claims and their equivalents.

What is claimed is:

1. A vehicle lift comprising a first beam assembly and a spaced apart second beam assembly, each beam assembly further comprising a rectangular frame, a first spaced apart pair of strut arms mounted outboard at first end of the frame, a second pair of spaced apart strut arms attached to a second end of the frame, a third pair of spaced apart strut ends attached inboard the frame at a center point, a fourth pair of strut arms attached inboard the frame substantially near the center point; a center beam positioned between the third pair of strut arms and the fourth pair of strut arms and overlying both ends of the frame, the center beam further having opposed sides with longitudinal channels provided therein; a first pin attaching the first pair of strut arms to the first end of the frame, a second pin attaching the fourth inner strut arms to the frame; a third pin through the second end of the first pair of strut arms and a fourth pin through the second end of the inner strut arms wherein the third and fourth pin pass through the channels of the center beam; a threaded collar mounted on the third pin and a threaded collar mounted on the fourth pin, a threaded shaft rotatably positioned through the first threaded collar and second threaded collar and wherein rotation of the threaded shaft imparts linear force on the threaded collar selectively and operatively drawing the collars closer together to elevate the strut arms and the attached center beam.

2. A mechanical vehicle lift comprising a first beam assembly and a spaced apart second beam assembly, each beam assembly further comprising a substantially rectangular tube frame; a first pair of outer strut arms attached at a first end of the frame and a second pair of outer strut arms attached at a second end of the frame; a first pair of inner strut arms attached substantially near the center of the frame and a second pair of inner strut arms attached substantially near the center of the frame and oriented generally toward the first end of the frame, and a second pair of inner strut arms attached substantially near the frame and oriented generally toward the second end of the frame; a center beam having opposed sides with a plurality of channels formed in each side positioned between the first pair of inner strut arms and the second pair of inner strut arms and the first pair of outer strut arms and the second pair of outer strut arms and extending longitudinally to the first end of the frame and the opposed second end of the frame; a first pin attaching the first pair of outer strut arms to the first end of the frame, a second pin attaching the second pair of outer strut arms to the second end of the frame, a third pin attaching the first inner pair of strut arms to the frame and a fourth pin attaching the second pair of inner strut arms to the frame; a fifth pin securing the first pair of outer strut arms through an inboard channel in the center beam, a sixth pin securing the second pair of outboard strut arms through a second inboard channel in the center beam, a seventh pin securing the first inboard pair of strut arms to an outboard channel in the center beam and an eighth pin securing the second inner pair of strut arms to a second outboard channel in the center beam; one internally threaded collar positioned on each of the fifth, sixth, seventh, and eighth pins between each respective pair of strut arms, a threaded shaft extending longitudinally along the frame, and positioned through each threaded collar mounted to the fifth, sixth, seventh, and eighth pins and whereupon directional rotation of the threaded shaft causes lateral and upward movement of each pair of strut arms as the threaded collars on each pair of inner and outer strut arms are pulled together.

3. The vehicle lift of claim 2 further comprising a second beam assembly, with substantially identical construction to the first beam assembly and operably connected to the first beam assembly with a connecting crank, such that rotation of the threaded shaft within the first beam assembly to elevate the strut assemblies and beam causes rotation of the threaded shaft and simultaneous elevation of the strut assemblies and beam of the second beam assembly.

4. The vehicle lift of claim 2 wherein the threaded collars each have acme-type threads and the threaded shaft is reverse threaded with acme threads.

5. The vehicle lift of claim 2 further comprising a plurality of resilient springs mounted substantially adjacent the threaded shaft to supplement the lifting force of the strut assemblies.

6. The vehicle lift of claim 5 further comprising a plurality of force drive nuts movable along the threaded shaft as it is rotated, each such force drive nut having a receptacle for receiving a hook on at least one resilient spring as the beam assembly is elevated.

7. The vehicle lift of claim 6 wherein the hook on the at least one resilient spring disengages the force nut receptacle as the lift is elevated.

8. A mechanical vehicle lift comprising a first beam assembly and a spaced apart second beam assembly, each beam assembly further comprising a frame; a first pair of outer strut arms pivotally attached at a first end of the frame and a second pair of outer strut arms pivotally attached at a second end of the frame; a first pair of inner strut arms pivotally attached substantially near the center of the frame generally oriented toward the second end of the frame and a second pair of inner strut arms pivotally attached substantially near the center of the frame and oriented generally toward the first end of the frame, and a second pair of inner strut arms attached substantially near the frame and oriented generally toward the second end of the frame; a center beam having opposed sides with a plurality of channels formed in each side positioned between each of the four pairs of strut arms and extending longitudinally between the first and second end of the frame; a plurality of fasteners slidably connecting each strut pair through the channels of the center beam; at least one internally threaded collar positioned on each of the fasteners positioned through the channels of the center beam, a threaded shaft positioned through each threaded collar and wherein directional rotation of the threaded shaft selectively results in upward movement of each pair of strut arms as the threaded collars on each pair of inner and outer strut arms are pulled together.

9. The vehicle lift of claim 8 further comprising a second beam assembly, with substantially identical construction to the first beam assembly and operably connected to the first beam assembly with a connecting shaft, such that rotation of the shaft within the first beam assembly to elevate the strut assemblies and beam causes simultaneous elevation of the strut assemblies and beam of the second beam assembly.

10. The vehicle lift of claim 8 wherein the threaded collars each have acme-type threads and the threaded shaft is reverse threaded with acme threads.

11. The vehicle lift of claim 8 further comprising a plurality of resilient springs mounted substantially adjacent the threaded shaft to supplement the lifting force of the strut assemblies.

12. The vehicle lift of claim 11 further comprising a plurality of force drive nuts movable along the threaded shaft as it is rotated, each such force drive nut having a receptacle for receiving a hook on at least one resilient spring as the beam assembly is elevated.

13. The vehicle lift of claim 12 wherein hook on the at least one resilient spring disengages the force nut receptacle as the lift is elevated.

14. The vehicle lift of claim 11 further comprising an inner shaft seat adjacent a miter gear and an outer shaft seat at each end of the threaded shaft.

15. The vehicle lift of claim 14 further comprising at least one compression spring mounted on the inner shaft seat and at least one compression spring mounted on the outer shaft seat.

16. The vehicle lift of claim 15 wherein the at least one compression spring on the inner shaft seat and the at least one compression spring on the outer shaft seat are compressed against the threaded collars on the threaded shaft when the beam assembly is in the lowered position and the compression springs provide lift assistance as the beam assembly is elevated by exerting spring force against the threaded collars.

17. The vehicle lift of claim 8 further comprising a first miter gear positioned at the threaded shaft of the first beam assembly and driving a connecting crank rod which is connected to a second miter gear at the threaded shaft of the second beam assembly and wherein the rotation of the threaded shafts of the first and second beam assemblies are synchronized.

18. The vehicle lift of claim 8 further comprising a power crank rod intermediate an electric drive motor and the miter gear of the first beam assembly.

19. The vehicle lift of claim 8 further comprising a second beam assembly, with substantially identical construction to the first beam assembly and operably connected to the first beam assembly with a connecting crank, such that rotation of the threaded shaft within the first beam assembly to elevate the strut assemblies and beam causes rotation of the threaded shaft and synchronized elevation of the strut assemblies and beam of the second beam assembly.

20. The vehicle lift of claim 8 further comprising a plurality of casters mounted to the frames of the first and second beam assemblies.

* * * * *